US007574158B2

(12) United States Patent
Uehara

(10) Patent No.: US 7,574,158 B2
(45) Date of Patent: Aug. 11, 2009

(54) FIXING DEVICE, AND IMAGE FORMING APPARATUS PROVIDED WITH FIXING DEVICE

(75) Inventor: Masakazu Uehara, Osaka (JP)

(73) Assignee: Kyocera Mita Corporation (JP)

( * ) Notice: Subject to any disclaimer, the term of this patent is extended or adjusted under 35 U.S.C. 154(b) by 299 days.

(21) Appl. No.: 11/789,933

(22) Filed: Apr. 26, 2007

(65) Prior Publication Data

US 2007/0253756 A1 Nov. 1, 2007

(30) Foreign Application Priority Data

Apr. 28, 2006 (JP) ..... 2006-126482

(51) Int. Cl.
*G03G 15/16* (2006.01)

(52) U.S. Cl. ..... 399/122; 399/124; 399/401

(58) Field of Classification Search ..... 399/16, 399/122, 124, 125, 322, 401
See application file for complete search history.

(56) References Cited

U.S. PATENT DOCUMENTS

2003/0108359 A1* 6/2003 Chung ..... 399/124
2006/0193666 A1* 8/2006 Tomatsu ..... 399/401

FOREIGN PATENT DOCUMENTS

JP 2005-55817 3/2005

* cited by examiner

*Primary Examiner*—David M Gray
*Assistant Examiner*—Roy Yi
(74) *Attorney, Agent, or Firm*—Gerald E. Hespos; Anthony J. Casella

(57) ABSTRACT

A fixing device has a roller pair; a cover for defining a forward transport path, and a backward transport path for transporting a sheet discharged from the roller pair back to an image former for forming toner images on both sides of the sheet. A sheet detection arm has opposite ends extending respectively in the forward and backward transport paths. A first shaft in the cover is mounted to a center of pivotal movement of the sheet detection arm and extends orthogonal to the sheet transport direction. A secondary shaft transmits rotation of the first shaft when the cover is closed, but not when the cover is opened. A sensor detects whether the sheet is being transported forward or backward based on rotation of the second shaft. The sheet detection arm pivots out of the backward transport path in response to opening of the cover.

15 Claims, 7 Drawing Sheets

FIXING DEVICE, AND IMAGE FORMING APPARATUS PROVIDED WITH FIXING DEVICE

BACKGROUND OF THE INVENTION

1. Field of the Invention

The present invention relates to a fixing device for use in an image forming apparatus such as a copier, a fax, or a printer.

2. Description of the Background Art

Generally, an image forming apparatus such as a printer performs an image formation to a sheet by transferring a toner image formed on a photosensitive drum onto the sheet, followed by fixing the toner image on the sheet.

A fixing unit adapted to fix a toner image generally has a pair of fixing rollers which are heated and pressurized. The toner image is fixed by allowing a sheet to pass a nip area defined by the fixing roller pair. The fixing unit is likely to cause a sheet jam because the sheet is heated and pressurized while passing the fixing unit. In view of this, there is provided a sheet detection arm, at a downstream position of the fixing roller pair, for detecting a sheet to be discharged from the fixing roller pair.

In order to facilitate a user to remove a jammed sheet, for instance, an image forming apparatus designed for single-sided printing, e.g. disclosed in Japanese Unexamined Patent Publication No. 2005-55817, has an openable/closable fixing cover for covering a fixing roller pair.

Also, in recent years, image forming apparatuses capable of double-sided printing onto a sheet have been widespread. In such image forming apparatuses, there is defined a backward transport path, at a position below a fixing roller pair, for transporting a sheet discharged from the fixing roller pair to an image forming unit again.

In the image forming apparatuses capable of double-sided printing, there is provided a sheet detection arm for detecting transport of a sheet in a forward transport path and in the backward transport path after the sheet is discharged from the fixing roller pair. The sheet detection arm is a pivotal member, with one end thereof extending in the forward transport path, and the other end thereof extending in the backward transport path. The sheet detection arm is a single member adapted to detect the sheet transport in the two transport paths disposed vertically away from each other. Thus, the sheet detection by the single member enables to suppress increase of the number of parts constituting the image forming apparatus, and to reduce the dimensions of the image forming apparatus.

Similarly to the image forming apparatus adapted for single-sided printing, as recited in the above publication, it is desirable to provide an openable/closable fixing cover in the image forming apparatus capable of double-sided printing in order to facilitate a jammed sheet removal.

If, however, the openable/closable fixing cover is provided in the image forming apparatus capable of double-sided printing, the sheet detection arm is provided on the fixing cover, because a part of the fixing cover defines the forward transport path and the backward transport path. In this arrangement, in opening the fixing cover, the other end of the sheet detection arm extending in the backward transport path may be abutted against a lower guide constituting the backward transport path, which may cause breakage or damage of the sheet detection arm.

Thus, in a fixing device provided with the sheet detection arm for detecting a sheet in the two transport paths i.e. the forward transport path and the backward transport path, the sheet detection arm may be damaged in opening the openable/closable fixing cover.

SUMMARY OF THE INVENTION

In view of the above problems residing in the conventional examples, it is an object of the present invention to provide a fixing device with less likelihood of damage to a sheet detection arm in opening a fixing cover unit, and an image forming apparatus provided with the fixing device.

A fixing device according to an aspect of the invention which has accomplished the object comprises: a fixing unit including a fixing roller pair for fixing a toner image formed by an image forming unit on a sheet; an openable/closable fixing cover unit for defining a forward transport path for transporting the sheet discharged from the fixing roller pair, and a backward transport path, disposed below the forward transport path, for transporting the sheet discharged from the fixing roller pair to the image forming unit again for forming the toner image on both sides of the sheet; a sheet detection arm having one end thereof extending in the forward transport path, and the other end thereof extending in the backward transport path; a first rotary shaft provided in the fixing cover unit, the first rotary shaft being fixed to a center of pivotal movement of the sheet detection arm, and extending in a direction substantially orthogonal to a transport direction of the sheet; a second rotary shaft provided in the fixing unit, the second rotary shaft being so constructed that a rotation of the first rotary shaft is transmitted by a contact thereof with one end of the first rotary shaft in a state that the fixing cover unit is closed, and that the contact with the one end of the first rotary shaft is released in a state that the fixing cover unit is opened; and a sensor unit, provided in the fixing unit, for detecting whether the sheet is being transported at least in the forward transport path and in the backward transport path in accordance with a rotation of the second rotary shaft transmitted from the first rotary shaft, wherein the sheet detection arm is pivotally moved in such a direction as to retract from the backward transport path in response to an opening of the fixing cover unit.

An image forming apparatus according to another aspect of the invention comprises a sheet cassette for housing sheets therein; an image forming unit for forming a toner image on the sheet dispensed from the sheet cassette; a fixing device for fixing the toner image on the sheet; and a discharge tray for discharging the sheet carrying the fixed toner image, wherein the fixing device has the aforementioned arrangement.

These and other objects, features and advantages of the present invention will become more apparent upon reading the following detailed description along with the accompanying drawing.

DETAILED DESCRIPTION OF THE PREFERRED EMBODIMENTS

Figure 1:
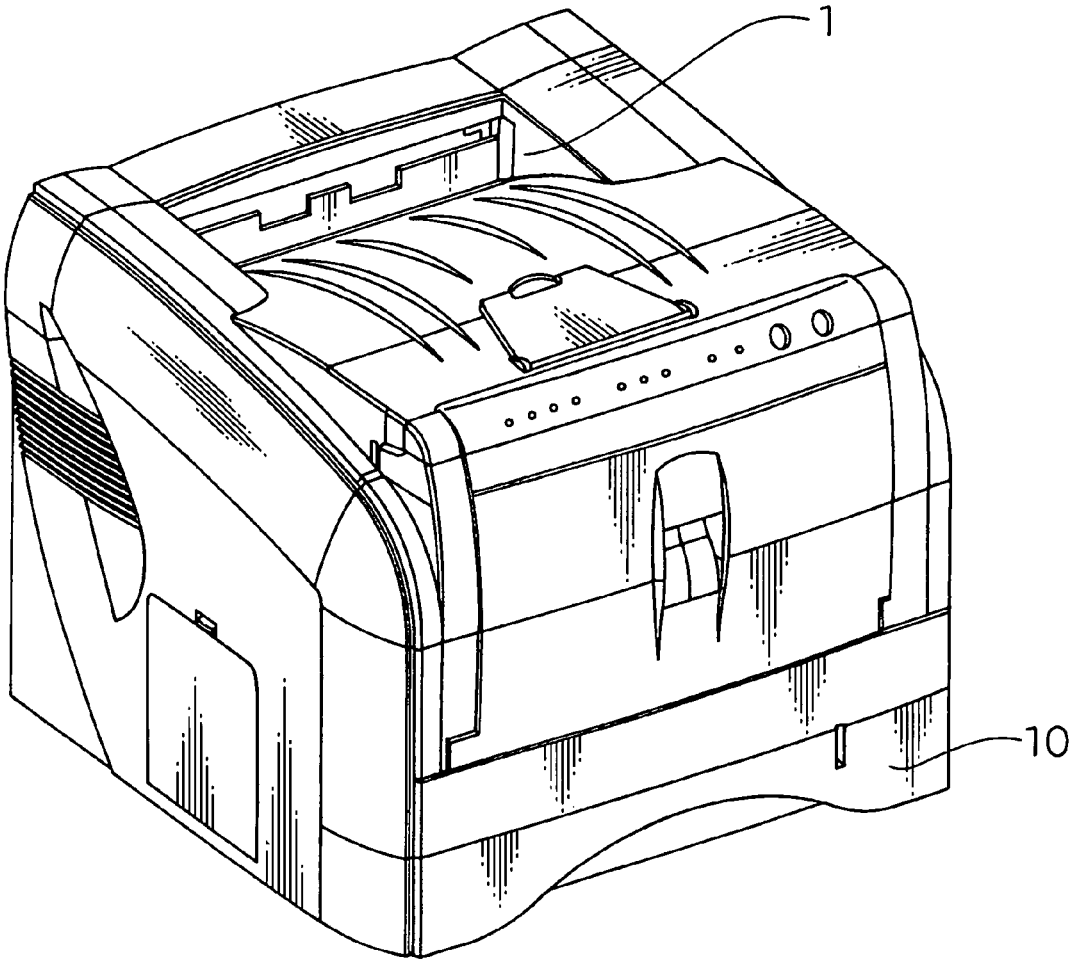
FIG. 1 is a perspective view showing an external appearance of a printer according to an embodiment of the invention.

In the following, a printer as an example of an image forming apparatus embodying the invention is described referring to the drawings, and an example of a fixing device embodying the invention is also described in association with the printer.

FIG. 1 is a perspective view showing an external appearance of the printer embodying the invention. As shown in FIG. 1, a face-down tray 1 is provided on an upper part of the printer. A sheet cassette 10 is provided at a bottom part of the printer.

Figure 2:
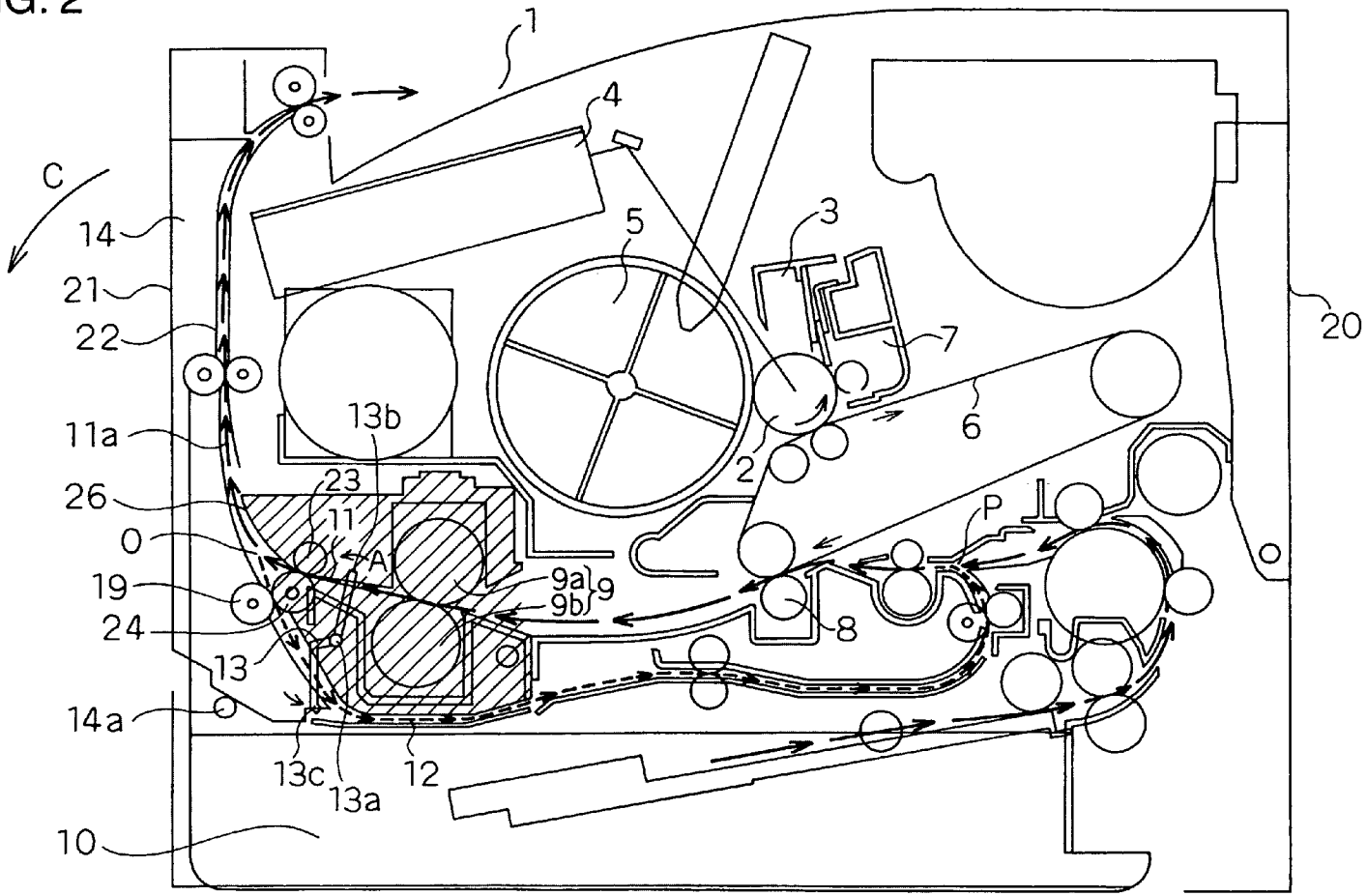
FIG. 2 is a side view showing an internal arrangement of the printer.

FIG. 2 is a side view showing an internal arrangement of the printer embodying the invention. As shown in FIG. 2, the printer includes a photosensitive drum 2, a charging unit 3 for charging the surface of the photosensitive drum 2, an exposure unit 4 for forming an electrostatic latent image, a rotary developing unit 5 equipped with four colors of toners i.e. black, magenta, cyan, and yellow, an intermediate transfer belt 6 on which a toner image formed on the photosensitive drum 2 is temporarily transferred, and a cleaning unit 7 for removing toner residuals from the surface of the photosensitive drum 2 after the image transfer.

The printer is also provided with a transfer roller 8 for transferring the toner image temporarily transferred to the intermediate transfer belt 6 onto a sheet, and a fixing roller pair 9 for heating and pressurizing the sheet to fix the transferred toner image on the sheet. The fixing roller pair 9 has a heat roller 9*a* to be heated by a built-in heater, and a pressure roller 9*b* to be pressed against the heat roller 9*a*.

In the following, a sheet transport path is described. In this embodiment, a forward transport path 11 and a backward transport path 12 are provided as the sheet transport path.

The forward transport path 11 is, as shown by the solid arrows in FIG. 2, a transport path which is directed from the sheet cassette 10 toward a front wall 20 of the printer, bent upward, passed between the transfer roller 8 and the intermediate transfer belt 6, directed toward a rear wall 21 of the printer, directed upward along the rear wall 21 after passing the fixing roller pair 9, and then extends to the face-down tray 1 for transporting a sheet.

The backward transport path 12 is, as shown by the dotted arrows in FIG. 2, a transport path which is branched out from the forward sheet transport path 11 at a position near downstream of the fixing roller pair 9 i.e. O-position shown in FIG. 2 with respect to a sheet transport direction in the forward transport path 11, is passed below the forward transport path 11 and the fixing roller pair 9, and then joins the forward transport path 11 at a position upstream of the transfer roller 8 i.e. P-position shown in FIG. 2.

The backward transport path 12 is a transport path for guiding a sheet to the transfer roller 8 again in performing a double-sided printing on the sheet. There are arranged a driven roller 23, a drive roller 24, and a driven roller 19 in this order from the upper position, between the O-position and the fixing roller pair 9. The forward transport path 11 extends between the driven roller 23 and the drive roller 24, and is directed to the O-position. The backward transport path 12 extends from the O-position to the P-position via the drive roller 24 and the driven roller 19.

As shown in FIG. 2, assuming that a portion from the O-position of the forward transport path 11 to the face-down tray 1 is defined as a forward transport path section 11*a*, a member constituting a back surface transport guide 22 of the forward transport path section 11*a* corresponding to the rear wall 21 of the printer serves as an openable/closable member 14 which is made openable and closable by pivotally moving the member 14 in the direction shown by the arrow C about a pivot pin 14*a* provided near the bottom part of the printer. When the openable/closable member 14 is opened, the openable/closable member 14 is usable as a face-up tray.

In the following, a sheet detection arm 13 for detecting whether a sheet is in the forward transport path 11 and in the backward transport path 12 is described.

Figure 3:
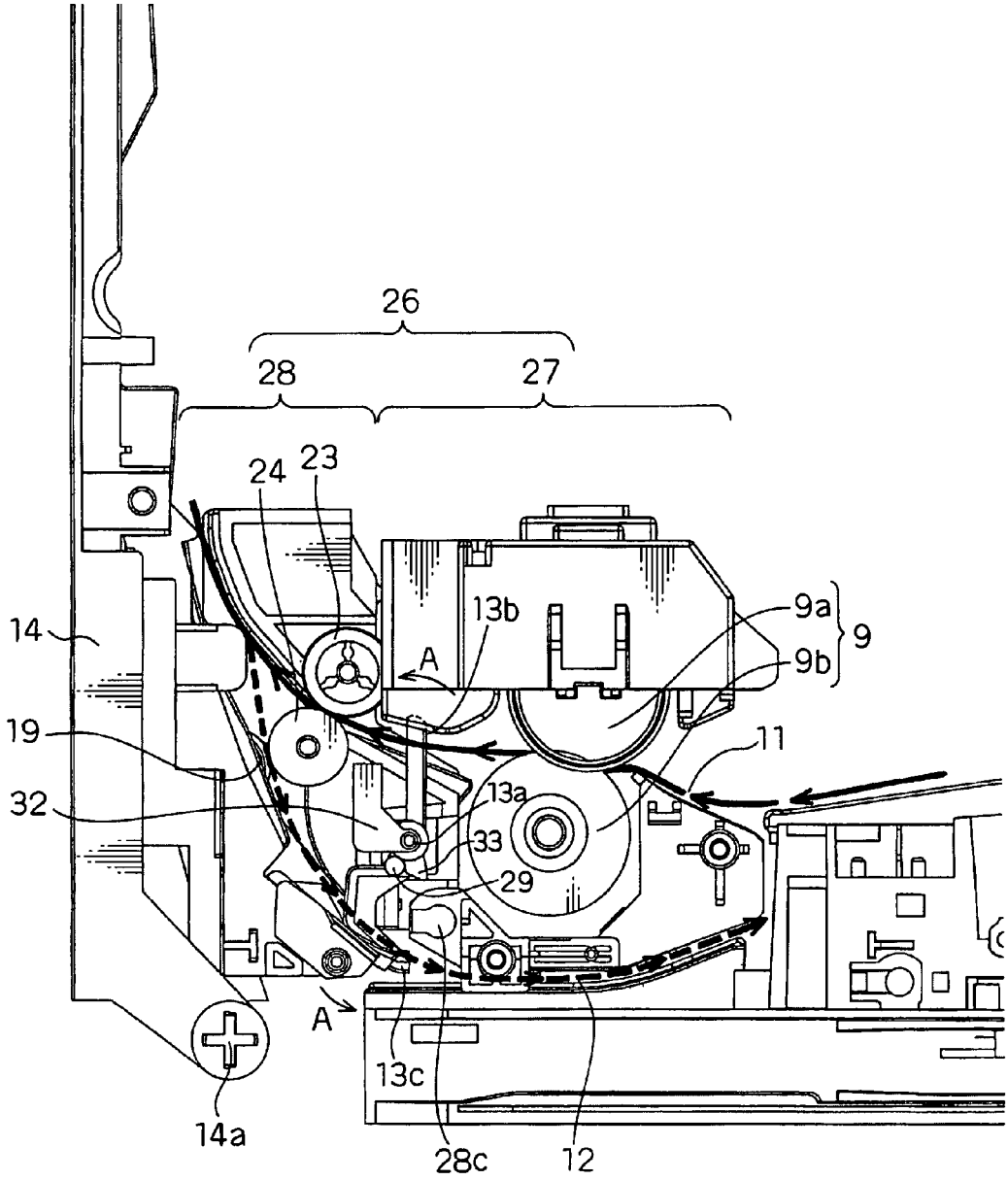
FIG. 3 is a partially enlarged side view of the printer.

FIG. 3 is a partially enlarged side view of the printer embodying the invention. As shown in FIG. 3, the printer has the sheet detection arm 13, as a pivotal arm. The sheet detection arm 13 is arranged in such a manner that one end 13*b* thereof extends in the forward transport path 11 between the drive roller 24 and the fixing roller pair 9, and the other end 13*c* thereof extends in the backward transport path 12.

The sheet detection arm 13 has a center 13*a* of pivotal movement between the forward transport path 11 and the backward transport path 12 so that the sheet detection arm 13 is pivotable about the center 13*a* of pivotal movement. When the sheet detection arm 13 is pushed by a lead end of a sheet being transported in the forward transport path 11, the sheet detection arm 13 is pivotally moved in the directions shown by the arrows A in FIG. 3, whereby the sheet is detected. When the sheet has passed the forward transport path 11, the sheet detection arm 13 is returned to an initial position by an unillustrated spring member or the like. Likewise, when the sheet is transported in the backward transport path 12, the sheet detection arm 13 is pivoted in the directions shown by the arrows A in FIG. 3, whereby the sheet is detected.

The aforementioned fixing roller pair 9, the driven roller 23, the drive roller 24, and the sheet detection arm 13 constitute a fixing device 26. In FIG. 2, the fixing device 26 is shown by the hatched portion.

Figure 4:
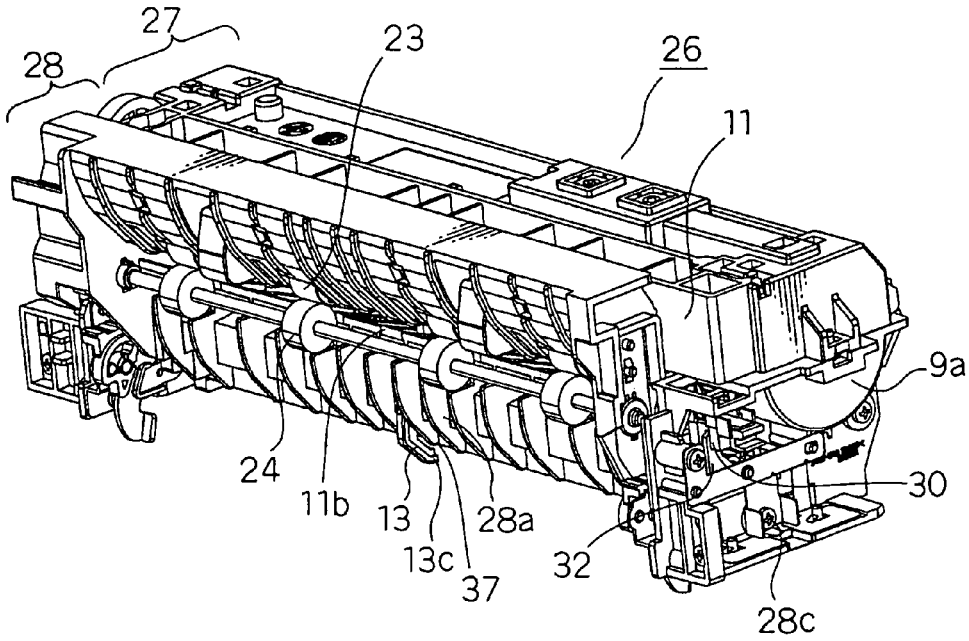
FIG. 4 is a perspective view showing an external appearance of a fixing device according to an embodiment of the invention.

In the following, the fixing device embodying the invention is described. FIG. 4 is a perspective view showing an external appearance of the fixing device 26 embodying the invention. As shown in FIG. 4 and FIG. 3, the fixing device 26 includes a fixing unit 27 to which the fixing roller pair 9 is rotatably attached, and a fixing cover unit 28 which is openably and closably attached to the fixing unit 27.

Figure 5:
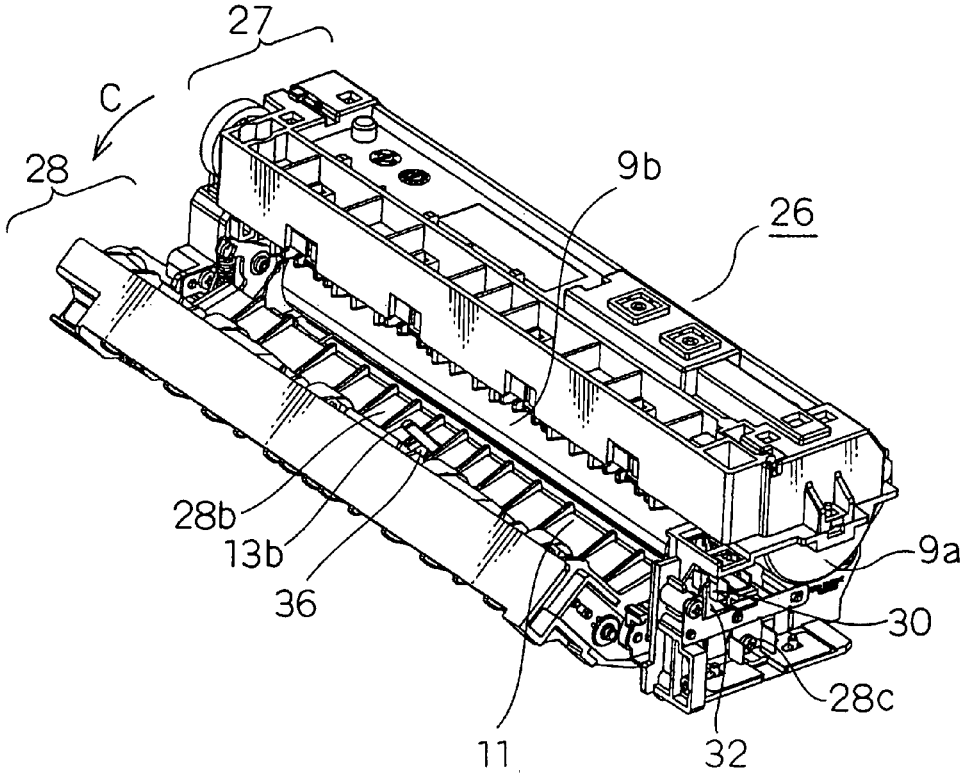
FIG. 5 is a perspective view showing an external appearance of the fixing device in a state that a fixing cover unit of the fixing device is opened.

FIG. 5 is a perspective view of the fixing device 26 in a state that the fixing cover unit 28 is opened. As shown in FIG. 4 and FIG. 5, the fixing cover unit 28 is pivotally openable and closable about a pivot pin 28*c* (see FIG. 3) arranged below the fixing unit 27. Assuming that a portion of the forward transport path 11 shown in FIG. 2 from the fixing roller pair 9 to a position between the driven roller 23 and the drive roller 24 is defined as a forward transport path section 11*b*, the forward transport path section 11*b* extends from a position between the driven roller 23 arranged on an outer wall 28*a* of the fixing cover unit 28 in FIG. 4 and the drive roller 24 toward the fixing roller pair 9. Also, a portion of the outer wall 28*a* of the fixing cover unit 28 below the drive roller 24 defines an upper guide of the backward transport path 12.

Slits 36 and 37 extending in the sheet transport direction are formed in an inner wall 28*b*, as a first wall, of the fixing cover unit 28, and in the outer wall 28*a*, as a second wall, of the fixing cover unit 28 in accordance with the shapes of the inner wall 28*b* and the outer wall 28*a*, respectively. The sheet detection arm 13 is provided in the fixing cover unit 28 in such a manner that the both ends 13*b* and 13*c* project through the slits 36 and 37, respectively.

Figure 6:
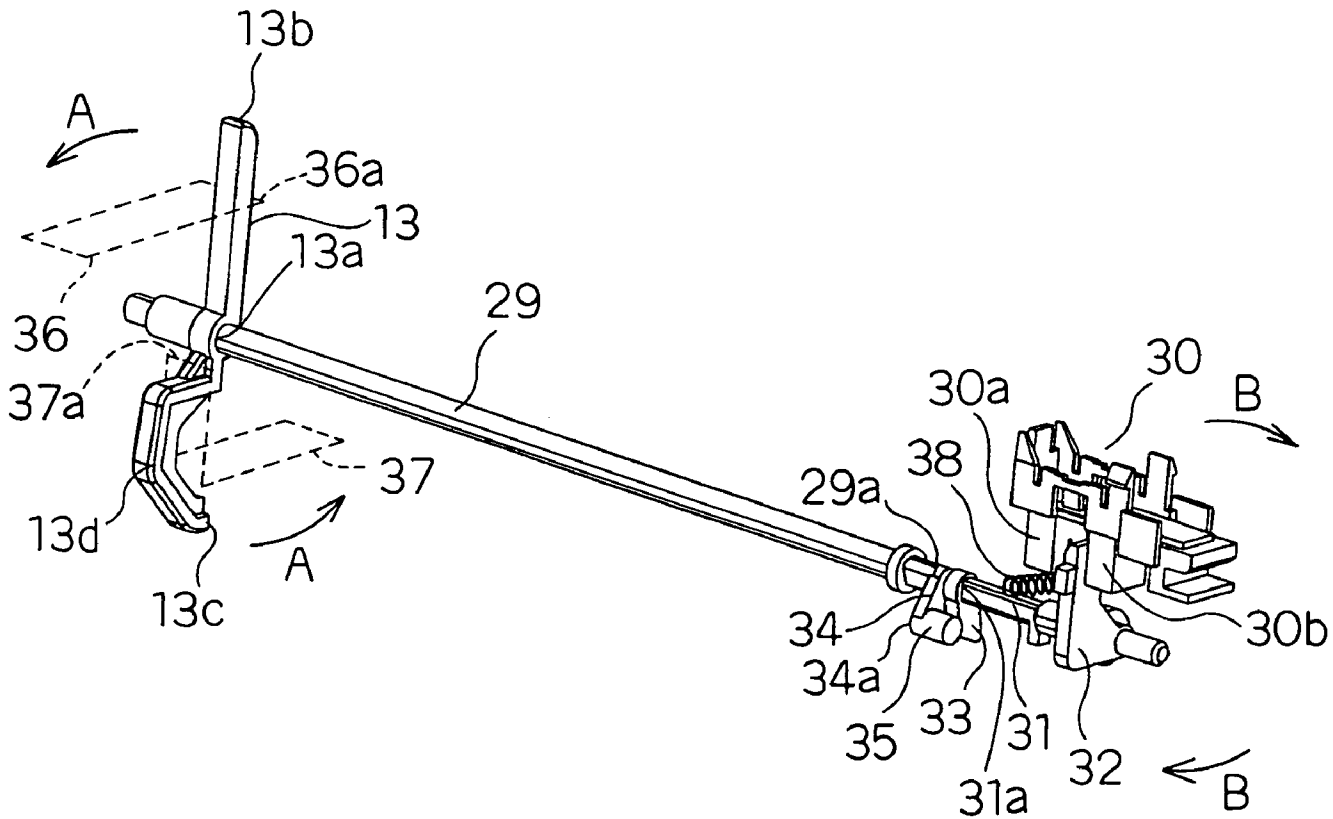
FIG. 6 is a perspective view showing an arrangement of detecting a sheet.

In the following, an arrangement of detecting a sheet by the sheet detection arm 13 is described. FIG. 6 is a perspective view showing the arrangement of detecting a sheet by the sheet detection arm 13. FIG. 6 is a diagram showing a state that the fixing cover unit 28 is closed. The slits 36 and 37 are indicated by the dotted lines in FIG. 6. As shown in FIG. 6, the center of pivotal movement of the sheet detection arm 13 is fixed to a rotary shaft 29. The rotary shaft 29 extends in a direction substantially orthogonal to the sheet transport direction, and is rotatably attached to the fixing cover unit 28 described referring to FIG. 3. The directions of pivotal movement of the sheet detection arm 13 when the sheet detection arm 13 is pushed by a sheet being transported in the forward transport path 11 and in the backward transport path 12 are shown by the arrows A in FIG. 6.

A portion of the sheet detection arm 13 extending from the center 13*a* of pivotal movement toward the one end 13*b* is formed into a substantially quadrangular prismatic member, with its length extending toward the one end 13*b*. A portion of the sheet detection arm 13 extending from the center 13*a* of pivotal movement toward the other end 13*c* is formed into a curved portion 13*d*, which is curved in a direction opposite to the direction shown by the lower arrow A in FIG. 6 i.e. the sheet transport direction in the backward transport path 12. The sheet detection arm 13 has its centroid adjusted in such a manner that the sheet detection arm 13 is pivotable in the directions shown by the arrows A in FIG. 6, and is kept in a substantially horizontal position, when movements of the rotary shaft 29 and the sheet detection arm 13 are not restrained by the other member e.g. a restrainer, which will be described later.

The fixing unit 27 is further provided with an optical sensor 30 comprised of a light emitting device 30*a* and a light receiving device 30*b* shown in FIG. 6. The fixing unit 27 is further provided with a rotary shaft 31 which is rotatably mounted substantially coaxially with the rotary shaft 29 in a state that the fixing cover unit 28 is closed. A plate-like blocking member 32 which is movable between the light emitting device 30*a* and the light receiving device 30*b* is fixedly attached to the rotary shaft 31.

A contact member 33 is mounted on one end 31*a* of the rotary shaft 31 corresponding to one end of the rotary shaft 29. The contact member 33 extends from the one end 31*a* substantially vertically with respect to the longitudinal direction of the rotary shaft 31. A member 34 is mounted on one end 29*a* of the rotary shaft 29, and extends from the one end 29*a* substantially vertically with respect to the longitudinal direction of the rotary shaft 29. A contact member 35 is mounted on a lead end 34*a* of the member 34, and extends from the lead end 34*a* in the longitudinal direction of the rotary shaft 29. The contact members 33 and 35 are contacted with each other in a state that the fixing cover unit 28 is closed. The contact member 35 and the contact member 33 are arranged in this order in the direction shown by the lower arrow A in FIG. 6.

Assuming that directions opposite to the pivotal movement directions A of the sheet detection arm 13 are defined as directions B in FIG. 6, a biasing force is acted on the blocking member 32 by a spring member 38 so that the blocking member 32 is pivotable in the directions B. The biasing force in the directions shown by the arrows B is applied to the contact member 33 via the rotary shaft 31, and is applied to the contact member 35 in contact with the contact member 33. The biasing force applied to the contact member 35 is then transmitted to the sheet detection arm 13 via the rotary shaft 29. As a result, the biasing force is applied to the sheet detection arm 13 in the directions shown by the arrows B i.e. directions opposite to the sheet transport directions. By application of the biasing force, the sheet detection arm 13 is contacted against an end portion 36*a* of the slit 36. The end portion 36*a* is formed at an upstream position with respect to the sheet transport direction in the forward transport path 11. In other words, a pivotal movement of the sheet detection arm 13 is restrained by the end portion 36*a*.

In the embodiment, the rotary shaft 29 corresponds to an example of a first rotary shaft in the claimed invention, and the rotary shaft 31 corresponds to an example of a second rotary shaft in the claimed invention. The expression "substantially coaxially" in the specification means a coaxial condition in a generally accepted idea. The end portion 36*a* corresponds to an example of a restrainer in the claimed invention, and the spring member 38 corresponds to an example of a biasing member in the claimed invention. The photosensitive drum 2, the charging unit 3, the exposure unit 4, the developing unit 5, the intermediate transfer belt 6, and the cleaning unit 7 correspond to an example of an image forming unit in the claimed invention.

In the following, an operation of the fixing device embodying the invention is described. First, a sheet detecting operation is described.

Figure 7A:
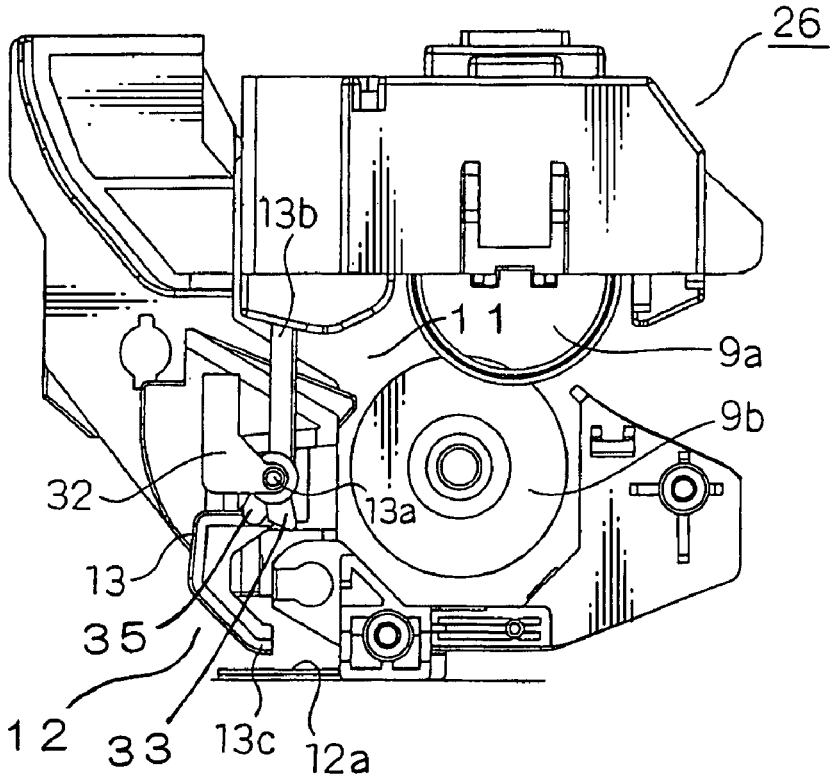
FIG. 7A is a front view of the fixing device showing a state that a sheet is not transported.
Figure 7B:
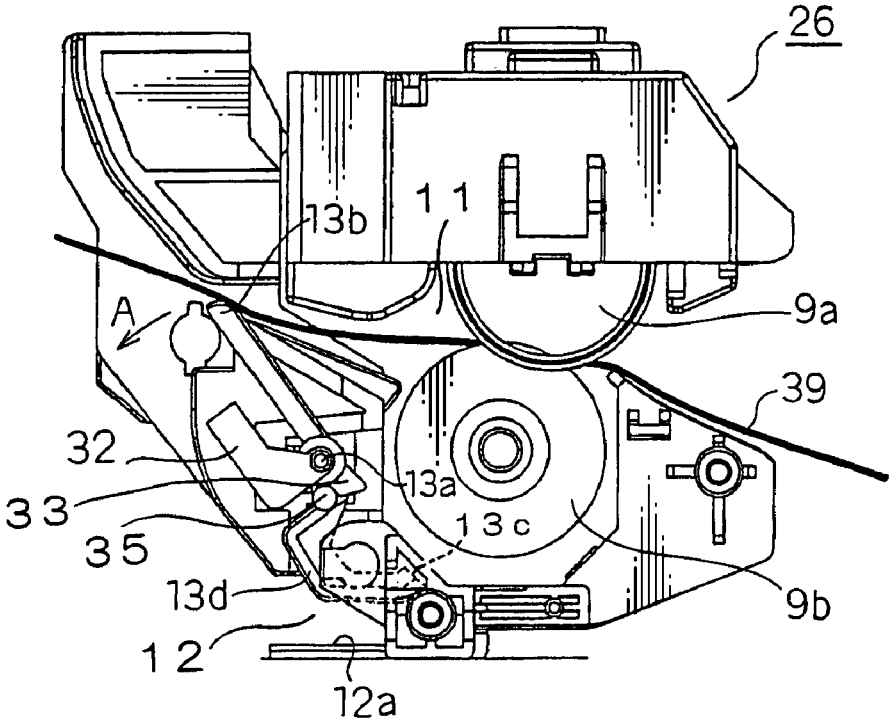
FIG. 7B is a front view of the fixing device showing a state that a sheet is being transported.

FIG. 7A is a front view of the fixing device in a state that a sheet is not transported. FIG. 7B is a front view of the fixing device in a state that a sheet is being transported in the forward transport path section 11*b*. The drive roller 24 and the driven roller 23 are not illustrated.

As shown in FIG. 7A, when the sheet is not transported in the forward transport path section 11*b*, the sheet detection arm 13 is kept upright. Then, as shown in FIG. 7B, when the sheet is transported, the one end 13*b* of the sheet detection arm 13 is pushed in the sheet transport direction by a sheet 39. Thereby, the sheet detection arm 13 is pivotally moved in the direction shown by the arrow A in FIG. 7B. The pivotal force of the sheet detection arm 13 is transmitted to the contact member 35 by way of the rotary shaft 29 (see FIG. 6).

Then, the pivotal force is transmitted to the contact member 33 in contact with the contact member 35, and then transmitted to the blocking member 32 by way of the rotary shaft 31. As the blocking member 32 is pivotally moved in the direction shown by the arrow A (see FIG. 7B), the light receiving device 30*b* of the optical sensor 30 is allowed to receive light from the light emitting device 30*a* (see FIG. 6). Upon detection of the light, the optical sensor 30 detects that the sheet 39 has been transported.

In the case where the sheet detection condition is continued for a predetermined time or more, a controller (not shown) is operated to suspend the operation of the printer, based on a judgment that a sheet jam has occurred.

As described in the section referring to FIG. 6, the sheet detection arm 13 is biased by the spring member 38 in the direction shown by the upper arrow B in FIG. 6. Accordingly, after the sheet 39 has been transported, the sheet detection arm 13 is pivotally moved in the direction shown by the upper arrow B in FIG. 6, is abutted against the end portion 36*a* of the slit 36, and is returned to the state shown in FIG. 7A.

When the sheet 39 is transported in the backward transport path 12, the other end 13*c* of the sheet detection arm 13 is pushed in the sheet transport direction (see the dotted arrows in FIG. 2), and the pivotal force of the sheet detection arm 13 is transmitted to the blocking member 32 in a similar manner as mentioned above, whereby the optical sensor 30 detects that the sheet 39 has been transported in the backward transport path 12.

Figure 8A:
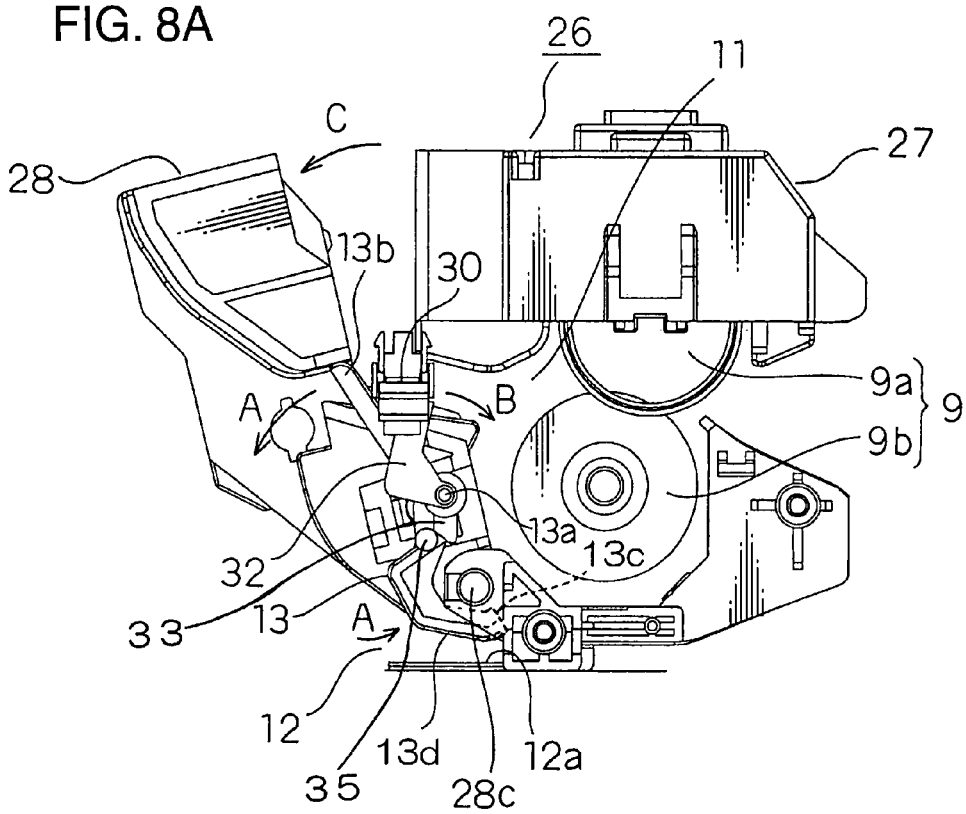
FIGS. 8A and 8B are explanatory diagrams for describing an operation of opening the fixing cover unit of the fixing device.
Figure 8B:
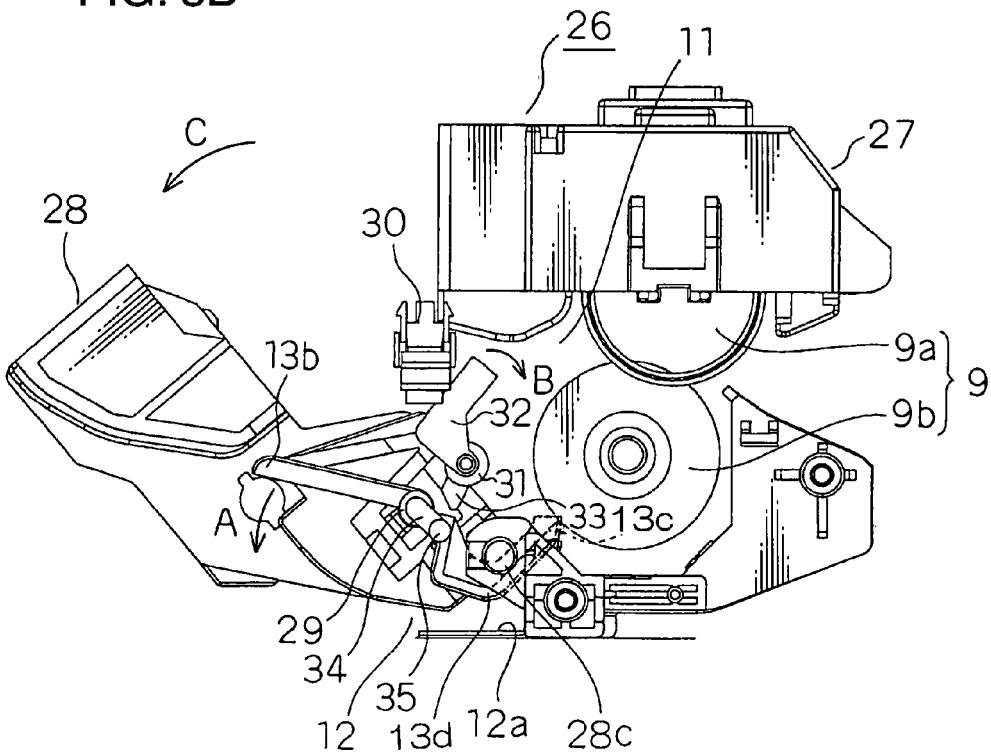

Next, an opening/closing operation of the fixing cover unit 28 is described. FIGS. 8A and 8B are diagrams showing the fixing device 26 for describing how the relevant parts are operated in response to a user's opening the fixing cover unit 28.

In the case where a sheet is jammed while being transported between the fixing roller pair 9, a sheet jam is detected as mentioned above, and an operation of the printer is suspended.

In such a case, first, the user opens the openable/closable member 14 to remove the jammed sheet (see the direction shown by the arrow C in FIG. 2). Then, the user is allowed to remove the sheet jammed in the forward transport path section 11*b* by opening the fixing cover unit 28.

Then, as shown in FIG. 8A, when the fixing cover unit 28 is pivotally opened in the direction shown by the arrow C about the pivot pin 28*c*, the rotary shaft 29 and the sheet detection arm 13 shown in FIG. 6 are pivotally moved in the direction shown by the arrow C together with the fixing cover unit 28, because the rotary shaft 29 and the sheet detection arm 13 are attached to the fixing cover unit 28. When the fixing cover unit 28 is further opened from the state shown in FIG. 8A, the rotary shaft 29 is detached from the rotary shaft 31 by pivotal movement of the rotary shaft 29 in the direction shown by the arrow C (see FIG. 8B).

As described above, the blocking member 32 is biased in the direction shown by the upper arrow B by the spring member 38 (see FIG. 6), and a pivotal movement of the sheet detection arm 13 by the biasing is restrained by the contact of the sheet detection arm 13 against the end portion 36*a* of the slit 36. Accordingly, in response to detachment of the rotary shaft 29 from the rotary shaft 31, the restraint of the pivotal movement of the blocking member 32 is released. Thereby, the blocking member 32 is pivotally moved in the direction shown by the arrow B (see FIG. 8B).

When the blocking member 32 is pivotally moved in the direction shown by the arrow B, the light receiving device 30*b* of the optical sensor 30 is allowed to receive the light from the light emitting device 30*a* (see FIG. 6). By the light detection, the optical sensor 30 enables to detect that the fixing cover unit 28 is opened. The light detection by the optical sensor 30 is controlled in such a manner that the optical sensor 30 is adapted to detect whether a sheet is being transported in the forward transport path and in the backward transport path when the fixing roller pair 9 is operated, and to detect whether the fixing cover unit 28 is opened when the fixing roller pair 9 is not operated.

As mentioned above, the sheet detection arm 13 has its centroid adjusted in such a manner that the sheet detection arm 13 is pivotally moved by about 90 degrees in the directions shown by the arrows A in FIG. 6, and is kept in a substantially horizontal position, when a movement thereof is not restrained. Accordingly, in response to opening of the fixing cover unit 28, the rotary shaft 29 is detached from the rotary shaft 31. Thereby, the sheet detection arm 13 is pivotally moved in the direction shown by the arrow A in FIG. 8B, is set in a substantially horizontal position, and the other end 13*c* of the sheet detection arm 13 is retracted from the backward transport path 12 (see FIG. 8B).

In this way, by opening the fixing cover unit 28, and allowing the other end 13*c* of the sheet detection arm 13 to be retracted from the backward transport path 12, contact of the other end 13*c* of the sheet detection arm 13 with a lower guide 12*a* (see FIG. 7B) constituting the backward transport path 12 can be restrained in opening the fixing cover unit 28. This enables to prevent breakage or damage of the sheet detection arm 13.

The embodiment describes the case that a sheet is jammed in the forward transport path 11. In addition to this, the sheet detection arm 13 is retracted within the fixing cover unit 28 when the fixing cover unit 28 is opened for maintenance service. This enables to prevent inadvertent breakage or damage of the sheet detection arm 13.

In this arrangement, there is no need of cautiously opening the fixing cover unit 28 so that the sheet detection arm 13 may not be damaged or broken. Accordingly, the arrangement enables to facilitate a process of removing a sheet which is detected to be jammed in the forward transport path 11 by the optical sensor 30.

In the case where a sheet is jammed in the backward transport path 12, and the jammed sheet detected by the optical sensor 30 is removed, the user is required to pivotally open the openable/closable member 14 in the direction shown by the arrow C (see FIG. 2), and to draw the sheet out of the backward transport path 12 in the direction opposite to the sheet transport direction because the sheet transport is suspended, with the jammed sheet in contact with the sheet detection arm 13. In this condition, since the curved portion 13*d* of the sheet detection arm 13 is contacted with the sheet, the user is allowed to smoothly remove the sheet without likelihood that the sheet may be stuck at the other end 13*c* of the sheet detection arm 13.

In the embodiment, the optical sensor 30 has three functions: detection of a sheet in the forward transport path 11, detection of a sheet in the backward transport path 12, and detection of opening/closing of the fixing cover unit 28. Alternatively, the optical sensor 30 may have two functions i.e. detection of a sheet in the forward transport path, and detection of a sheet in the backward transport path. As an embodiment of the optical sensor 30 having the two functions, a restrainer is provided on a side portion of the optical sensor 30 so that the blocking member 32 may not be pivotally moved in the directions shown by the arrows B in FIG. 6 from the position where the blocking member 32 blocks a light path of the optical sensor 30.

In the case where opening/closing of the fixing cover unit 28 is detected, providing the optical sensor 30 with the three functions as proposed in the embodiment eliminates the need of providing a dedicated sensor for detecting opening/closing of the fixing cover unit 28. This is more advantageous in suppressing increase of the number of parts constituting the printer, and reducing the dimensions and the production cost of the printer.

In the embodiment, the rotary shaft 29 and the rotary shaft 31 are arranged substantially coaxially. Alternatively, the rotary shaft 29 and the rotary shaft 31 may be axially displaced from each other. As far as the pivotal movement of the sheet detection arm 13 can be transmitted to the blocking member 32 by contact of the contact members 33 and 35, any arrangement is applicable.

In the embodiment, the pivotal movement of the sheet detection arm 13 by the spring member 38 is restrained by the contact of the sheet detection arm 13 against the end portion 36*a*. Alternatively, the pivotal movement of the sheet detection arm 13 may be restrained by a contact of the sheet detection arm 13 against an end portion 37*a* (see FIG. 6) of the slit 37. The end portion 37*a* is formed at an upstream position with respect to the sheet transport direction in the backward transport path 12. The end portion 37*a* is the end portion of the slit 37, which is formed at the upstream position with respect to the sheet transport direction in the backward transport path 12.

The fixing device according to the embodiment has less likelihood of damage to the sheet detection arm in opening the fixing cover unit, and accordingly is useful in an image forming apparatus such as a printer, a copier, or a fax.

The aforementioned embodiment primarily embraces the inventions having the following arrangements.

A fixing device according to an aspect of the invention comprises: a fixing unit including a fixing roller pair for fixing a toner image formed by an image forming unit on a sheet; an openable/closable fixing cover unit for defining a forward transport path for transporting the sheet discharged from the fixing roller pair, and a backward transport path, disposed below the forward transport path, for transporting the sheet discharged from the fixing roller pair to the image forming unit again for forming the toner image on both sides of the sheet; a sheet detection arm having one end thereof extending in the forward transport path, and the other end thereof extending in the backward transport path; a first rotary shaft provided in the fixing cover unit, the first rotary shaft being fixed to a center of pivotal movement of the sheet detection arm, and extending in a direction substantially orthogonal to a transport direction of the sheet; a second rotary shaft provided in the fixing unit, the second rotary shaft being so constructed that a rotation of the first rotary shaft is transmitted by a contact thereof with one end of the first rotary shaft in a state that the fixing cover unit is closed, and that the contact with the one end of the first rotary shaft is released in a state that the fixing cover unit is opened; and a sensor unit, provided in the fixing unit, for detecting whether the sheet is being transported at least in the forward transport path and in the backward transport path in accordance with a rotation of the second rotary shaft transmitted from the first rotary shaft, wherein the sheet detection arm is pivotally moved in such a direction as to retract from the backward transport path in response to an opening of the fixing cover unit.

An image forming apparatus according to another aspect of the invention comprises a sheet cassette for housing sheets therein; an image forming unit for forming a toner image on the sheet dispensed from the sheet cassette; a fixing device for fixing the toner image on the sheet; and a discharge tray for discharging the sheet carrying the fixed toner image, wherein the fixing device has the aforementioned arrangement.

The above arrangements enable to provide the fixing device with less likelihood of damage to the sheet detection arm in opening the fixing cover unit, and the image forming apparatus provided with the fixing device, respectively.

Preferably, in the above arrangement, the sensor unit may include: an optical sensor having a light emitting device and a light receiving device; and a blocking member which is moved between the light emitting device and the light receiving device in response to the rotation of the second rotary shaft.

Preferably, in the above arrangement, the fixing device may further comprise: a biasing member for biasing the blocking member attached to the second rotary shaft to apply such a force as to pivotally move the sheet detection arm in a direction opposite to the sheet transport direction in a state that the fixing cover unit is closed; and a restrainer for restraining the pivotal force, wherein the contact of the first rotary shaft with the second rotary shaft is released, and the restraint against the sheet detection arm is released in response to the opening of the fixing cover unit to thereby retract the sheet detection arm from the backward transport path by a pivotal movement of the sheet detection arm in the sheet transport direction.

Preferably, in the above arrangement, the sheet detection arm may be pivotally moved by being pushed by the sheet being transported in the forward transport path and in the backward transport path, the pivotal movement of the sheet detection arm may be transmitted to the blocking member by way of the first rotary shaft and the second rotary shaft, and the sheet transport may be detected by a movement of the blocking member and a release of light blocking of the optical sensor.

Preferably, the blocking member may be pivotally moved in response to the release of the contact of the first rotary shaft with the second rotary shaft, and the release of the restraint against the sheet detection arm by the restrainer in response to the opening of the fixing cover unit, and the sensor unit may detect that the fixing cover unit is opened when the optical sensor detects the pivotal movement of the blocking member.

Preferably, in the above arrangement, the first rotary shaft and the second rotary shaft may be substantially coaxially arranged in a state that the fixing cover unit is closed.

Preferably, in the above arrangement, the fixing cover unit may include a first wall for defining the forward transport path, and a second wall for defining the backward transport path, the first wall and the second wall each may be formed with a slit, the one end of the sheet detection arm may extend in the forward transport path through the slit of the first wall, and the other end of the sheet detection arm may extend in the backward transport path through the slit of the second wall.

A fixing device according to yet another aspect of the invention comprises: a fixing unit including a fixing roller pair for fixing a toner image on a sheet; a fixing cover unit which is made openable and closable relative to the fixing unit, the fixing cover unit including a first wall for defining a first transport path, and a second wall for defining a second transport path different from the first transport path; a pivotal arm having one end thereof projecting from the first wall, and the other end thereof projecting from the second wall; a first rotary shaft provided in the fixing cover unit, the first rotary shaft being fixed to a center of pivotal movement of the pivotal arm, and extending in a direction substantially orthogonal to a transport direction of the sheet; and a second rotary shaft provided in the fixing unit, the second rotary shaft being so constructed that a rotation of the first rotary shaft is transmitted by a contact thereof with one end of the first rotary shaft in a state that the fixing cover unit is closed, and that the contact with the one end of the first rotary shaft is released in a state that the fixing cover unit is opened, wherein the pivotal arm is pivotally moved in a state that the one end and/or the other end of the pivotal arm does not substantially project from the first wall and/or the second wall in response to the opening of the fixing cover unit.

The above arrangement enables to provide the fixing device with less likelihood of damage to the pivotal arm in opening the fixing cover unit.

This application is based on Japanese Patent Application No. 2006-126482 filed on Apr. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device comprising:

a fixing unit including a fixing roller pair for fixing a toner image formed by an image forming unit on a sheet;

an openable/closable fixing cover unit for defining a forward transport path for transporting the sheet discharged from the fixing roller pair, and a backward transport path, disposed below the forward transport path, for transporting the sheet discharged from the fixing roller pair to the image forming unit again for forming the toner image on both sides of the sheet;

a sheet detection arm having one end thereof extending in the forward transport path, and the other end thereof extending in the backward transport path;

a first rotary shaft provided in the fixing cover unit, the first rotary shaft being fixed to a center of pivotal movement of the sheet detection arm, and extending in a direction substantially orthogonal to a transport direction of the sheet;

a second rotary shaft provided in the fixing unit, the second rotary shaft being so constructed that a rotation of the first rotary shaft is transmitted by a contact thereof with one end of the first rotary shaft in a state that the fixing cover unit is closed, and that the contact with the one end of the first rotary shaft is released in a state that the fixing cover unit is opened; and a sensor unit, provided in the fixing unit, for detecting whether the sheet is being transported at least in the forward transport path and in the backward transport path in accordance with a rotation of the second rotary shaft transmitted from the first rotary shaft, wherein the sheet detection arm is pivotally moved in such a direction as to retract from the backward transport path in response to an opening of the fixing cover unit.

2. The fixing device according to claim 1, wherein the sensor unit includes:

an optical sensor having a light emitting device and a light receiving device; and a blocking member which is moved between the light emitting device and the light receiving device in response to the rotation of the second rotary shaft.

3. The fixing device according to claim 2, further comprising:

a biasing member for biasing the blocking member attached to the second rotary shaft to apply such a force as to pivotally move the sheet detection arm in a direction opposite to the sheet transport direction in a state that the fixing cover unit is closed; and a restrainer for restraining the pivotal force, wherein the contact of the first rotary shaft with the second rotary shaft is released, and the restraint against the sheet detection arm is released in response to the opening of the fixing cover unit to thereby retract the sheet detection arm from the backward transport path by a pivotal movement of the sheet detection arm in the sheet transport direction.

4. The fixing device according to claim 3, wherein the sheet detection arm is pivotally moved by being pushed by the sheet being transported in the forward transport path and in the backward transport path, the pivotal movement of the sheet detection arm is transmitted to the blocking member by way of the first rotary shaft and the second rotary shaft, and the sheet transport is detected by a movement of the blocking member and a release of light blocking of the optical sensor.

5. The fixing device according to claim 3, wherein the blocking member is pivotally moved in response to the release of the contact of the first rotary shaft with the second rotary shaft, and the release of the restraint against the sheet detection arm by the restrainer in response to the opening of the fixing cover unit, and the sensor unit detects that the fixing cover unit is opened when the optical sensor detects the pivotal movement of the blocking member.

6. The fixing device according to claim 1, wherein the first rotary shaft and the second rotary shaft are substantially coaxially arranged in a state that the fixing cover unit is closed.

7. The fixing device according to claim 1, wherein the fixing cover unit includes a first wall for defining the forward transport path, and a second wall for defining the backward transport path, the first wall and the second wall each is formed with a slit, the one end of the sheet detection arm extends in the forward transport path through the slit of the first wall, and the other end of the sheet detection arm extends in the backward transport path through the slit of the second wall.

8. A fixing device comprising:

a fixing unit including a fixing roller pair for fixing a toner image on a sheet;

a fixing cover unit which is made openable and closable relative to the fixing unit, the fixing cover unit including a first wall for defining a first transport path, and a second wall for defining a second transport path different from the first transport path;

a pivotal arm having one end thereof projecting from the first wall, and the other end thereof projecting from the second wall;

a first rotary shaft provided in the fixing cover unit, the first rotary shaft being fixed to a center of pivotal movement of the pivotal arm, and extending in a direction substantially orthogonal to a transport direction of the sheet; and a second rotary shaft provided in the fixing unit, the second rotary shaft being so constructed that a rotation of the first rotary shaft is transmitted by a contact thereof with one end of the first rotary shaft in a state that the fixing cover unit is closed, and that the contact with the one end of the first rotary shaft is released in a state that the fixing cover unit is opened, wherein the pivotal arm is pivotally moved in a state that the one end and/or the other end of the pivotal arm does not substantially project from the first wall and/or the second wall in response to the opening of the fixing cover unit.

9. An image forming apparatus comprising:

a sheet cassette for housing sheets therein;

an image forming unit for forming a toner image on the sheet dispensed from the sheet cassette;

a fixing device for fixing the toner image on the sheet; and a discharge tray for discharging the sheet carrying the fixed toner image, wherein the fixing device includes:

a fixing unit including a fixing roller pair for fixing the toner image formed by an image forming unit on the sheet;

an openable/closable fixing cover unit for defining a forward transport path for transporting the sheet discharged from the fixing roller pair, and a backward transport path, disposed below the forward transport path, for transporting the sheet discharged from the fixing roller pair to the image forming unit again for forming the toner image on both sides of the sheet;

a sheet detection arm having one end thereof extending in the forward transport path, and the other end thereof extending in the backward transport path;

a first rotary shaft provided in the fixing cover unit, the first rotary shaft being fixed to a center of pivotal movement of the sheet detection arm, and extending in a direction substantially orthogonal to a transport direction of the sheet;

a second rotary shaft provided in the fixing unit, the second rotary shaft being so constructed that a rotation of the first rotary shaft is transmitted by a contact thereof with one end of the first rotary shaft in a state that the fixing cover unit is closed, and that the contact with the one end of the first rotary shaft is released in a state that the fixing cover unit is opened; and a sensor unit, provided in the fixing unit, for detecting whether the sheet is being transported at least in the forward transport path and in the backward transport path in accordance with a rotation of the second rotary shaft transmitted from the first rotary shaft, wherein the sheet detection arm is pivotally moved in such a direction as to retract from the backward transport path in response to an opening of the fixing cover unit.

10. The image forming apparatus according to claim 9, wherein the sensor unit includes:

an optical sensor having a light emitting device and a light receiving device; and a blocking member which is moved between the light emitting device and the light receiving device in response to the rotation of the second rotary shaft.

11. The image forming apparatus according to claim 10, further comprising:

a biasing member for biasing the blocking member attached to the second rotary shaft to apply such a force as to pivotally move the sheet detection arm in a direction opposite to the sheet transport direction in a state that the fixing cover unit is closed; and a restrainer for restraining the pivotal force, wherein the contact of the first rotary shaft with the second rotary shaft is released, and the restraint against the sheet detection arm is released in response to the opening of the fixing cover unit to thereby retract the sheet detection arm from the backward transport path by a pivotal movement of the sheet detection arm in the sheet transport direction.

12. The image forming apparatus according to claim 11, wherein the sheet detection arm is pivotally moved by being pushed by the sheet being transported in the forward transport path and in the backward transport path, the pivotal movement of the sheet detection arm is transmitted to the blocking member by way of the first rotary shaft and the second rotary shaft, and the sheet transport is detected by the movement of the blocking member and a release of light blocking of the optical sensor.

13. The image forming apparatus according to claim 11, wherein the blocking member is pivotally moved in response to the release of the contact of the first rotary shaft with the second rotary shaft, and the release of the restraint against the sheet detection arm by the restrainer in response to the opening of the fixing cover unit, and the sensor unit detects that the fixing cover unit is opened when the optical sensor detects the pivotal movement of the blocking member.

14. The image forming apparatus according to claim 9, wherein the first rotary shaft and the second rotary shaft are substantially coaxially arranged in a state that the fixing cover unit is closed.

15. The image forming apparatus according to claim 9, wherein the fixing cover unit includes a first wall for defining the forward transport path, and a second wall for defining the backward transport path, the first wall and the second wall each is formed with a slit, the one end of the sheet detection arm extends in the forward transport path through the slit of the first wall, and the other end of the sheet detection arm extends in the backward transport path through the slit of the second wall.

* * * * *